US006219949B1

(12) United States Patent
Pang

(10) Patent No.: US 6,219,949 B1
(45) Date of Patent: Apr. 24, 2001

(54) DOOR REMINDER

(76) Inventor: Simon Pang, 1301 S. Atlantic Blvd. #327 B, Monterey Park, CA (US) 91754

( * ) Notice: Subject to any disclaimer, the term of this patent is extended or adjusted under 35 U.S.C. 154(b) by 0 days.

(21) Appl. No.: 09/222,135

(22) Filed: Dec. 29, 1998

Related U.S. Application Data

(60) Provisional application No. 60/070,592, filed on Jan. 6, 1998.

(51) Int. Cl.[7] ..... G09F 23/00
(52) U.S. Cl. ..... 40/599; 40/331
(58) Field of Search ..... 40/331, 332, 325, 40/575, 568, 599; D20/42

(56) References Cited

U.S. PATENT DOCUMENTS

| | | | | |
|---|---|---|---|---|
| D. 329,468 | | 9/1992 | Hatt . | |
| D. 339,382 | | 9/1993 | Roberts . | |
| 1,272,394 | | 7/1918 | Devney . | |
| 1,276,735 | | 8/1918 | Devney . | |
| 1,984,559 | | 12/1934 | Wilcox . | |
| 2,305,426 | * | 12/1942 | Howell | 40/331 X |
| 2,447,226 | * | 8/1948 | Bennett | 40/599 X |
| 4,216,598 | * | 8/1980 | Newbert | 40/331 |
| 4,460,119 | * | 7/1984 | Goodfellow et al. | 40/331 X |
| 4,862,617 | * | 9/1989 | Cooke, Jr. et al. | 40/331 X |
| 4,897,945 | * | 2/1990 | Webb | 40/331 |

* cited by examiner

*Primary Examiner*—Terry Lee Melius
*Assistant Examiner*—William L. Miller

(57) ABSTRACT

A door reminder for hanging on a doorknob for delivering a message comprising a hanger, a flap and at least one electronic device to be actuated by the flap. The hanger is provided with a hanger opening for hanging the door reminder on the shank of the doorknob. The flap is rotatably and horizontally mounted on the hanger above the hanger opening and the flap is provided with a flap opening such that the doorknob can pass through the flap opening when the flap is rotated towards the surface of the hanger hanging on the shank of the doorknob through the hanger opening with the hanger located between the door and the flap. The flap is maintained at an operative angle of approximately 30 degrees above the front surface of the hanger by an urging component when the flap is not moved. Preferably the door reminder includes two electronic devices, one light emitting and one sound emitting. The two electronic devices are controlled by a switch component constructed to be actuated by the rotational movement of the flap when the flap is moved by a hand. The door reminder may further include a non-electrical display component for delivering message to people.

16 Claims, 9 Drawing Sheets

DOOR REMINDER

CROSS-REFERENCE TO RELATED APPLICATIONS

This application claims benefits to U.S. Provisional No. 60/07052 filed Jan. 6, 1998.

BACKGROUND OF THE INVENTION

1. Technical Field

This invention relates generally to devices for hanging on a doorknob for delivering message to people. More particularly, the invention concerns such a device with a hanger, a flap which is rotatably mounted on the hanger and at least one electronic device with switch component structured to be actuated by the rotational movement of the flap. The flap is rotated by a hand moving to grasp the doorknob. Preferably the invention includes two electronic devices, one light emitting and one sound emitting, which serve the function of attracting attention and/or delivering message. The invention may further include non-electrical display means for delivering message.

2. Background Information

It is not uncommon for people to forget doing something important before leaving the house in a rush. Sometimes this regrettable condition may lead to minor inconvenience and financial losses. But it could also lead to dire consequences such as lost of job, home and even lives. A person who often forgets to turn off the heater before leaving the house will have to pay a very expensive bill. A person who forgot to bring the door key may have to risk his/her life to climb back into the house or have the lock broken down by a locksmith with loss of time and money.

A person who forgot to bring an important report to work for a big business deal may find himself/herself jobless soon afterwards. A person who forgot to turn off the gas stove before leaving the house may find his/her house burnt down.

Certainly, forgetful people need a reliable reminding device at the door to help them remember important things to do before leaving the house. However, people with good memory also need a reliable reminding device when they want to deliver an important message to a household member who is sleeping or not home yet if they need to go out immediately. Many people resort to the basic tool of a memo slip stuck on the door with adhesive. This method does not always work for the absent-minded and people in a great hurry who just turn the doorknob and go. Memo slip adhered to a doorknob will cause inconvenience to people whom the message is not intended and they may fall off if people turn the doorknob without exercising extra care.

Even though prior art of U.S. Pat Nos. D339,382; D329,468; 1,984,559; 1,276,735 and 1,272,394 carry structures for hanging on a doorknob and they are used for delivering message, they suffer the same drawback as that of a memo slip for not being able to arouse enough attention, especially when they are used in a dim or dark surrounding or in a very hectic environment such as a busy office.

Thus, it is desirable to have a new and improved device which is more reliable and easy to use to deliver message to people at doors.

SUMMARY OF THE INVENTION

This invention solves the problems mentioned above with electronic device actuated by a rotatable flap which can be rotated by a hand moving to grasp a doorknob and with non-electrical display means for delivering message.

The present invention provides a reminding device for hanging on a doorknob on a door for delivering message to people. The invention comprises a hanger, a flap, at least one electronic device and an urging component for keeping the flap at an operative angle.

The hanger is a sheet of flat, elongate material having an upper portion and a lower portion. A hanger opening is provided on the upper portion of the hanger for hanging the invention on a doorknob. The hanger also has a back surface facing the door and a front surface facing away from the door.

The flap is provided with a flap opening and the flap is rotatably and horizontally mounted on the hanger above the hanger opening such that the doorknob can pass through both the hanger opening and the flap opening when the flap is rotated towards the front surface of the hanger. The flap is maintained at the operative angle of approximately 30 degrees above the front surface of the hanger by the urging component such that the operative angle is sufficiently large to enable a hand moving to grasp a doorknob to generate a rotational movement on the flap to turn on the electronic device but sufficiently small to allow the front view of the doorknob to be seen.

Preferably, the invention includes two electronic devices, one light emitting and one sound emitting, both of which are actuated by one flap-actuated switch constructed to be actuated by the rotational movement of the flap.

Message can be delivered by voice reproduced from data stored in a memory chip and/or by light from a plurality of light producing components in specific orientation. When the invention comprises a holding component, e.g. a clip, for holding a planar display component, e.g. a memo pad, only a simple sound signal, e.g. beeping sound, can be used and as few as one light producing component for attracting attention and/or illumination can be used.

It should be understood that different embodiments of the invention can be constructed without departing from the spirit of the invention which will be made apparent from the remainder of the specification and claims.

The primary objective of this invention is to provide a reminding device for hanging on a doorknob, which reminding device is able to emit light and/or sound for attracting attention and/or delivering message when the doorknob with the invention on is speed.

Another objective of this invention is to provide a reminding device for hanging on a doorknob, which reminding device consumes electricity only when a doorknob with the invention on is grasped.

Another objective of this invention is to produce a reminding device which is reliable, easy to use, cheap to manufacture and has great potential demand.

Other objectives and advantages will be made apparent to one skilled in the art from the drawings and detailed description below.

DESCRIPTION OF THE INVENTION

The preferred embodiment of the present invention and its advantages are best understood by referring to FIGS. 1–8 of the drawings, like numerals being used for corresponding parts of the same embodiment.

Figure 1:
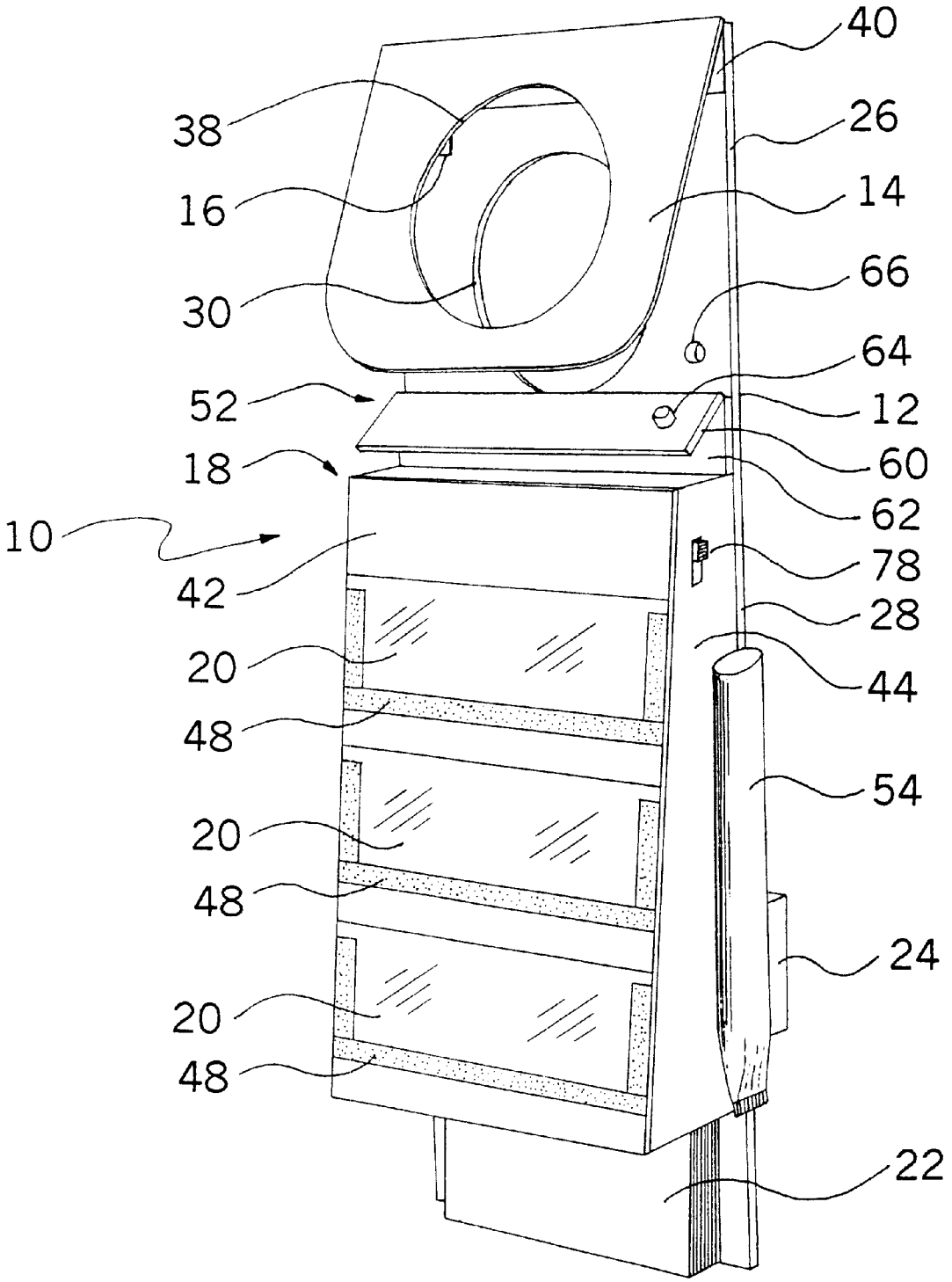
FIG. 1 is a perspective view of an embodiment of this invention comprising a cap with a translucent display panel.
Figure 2:
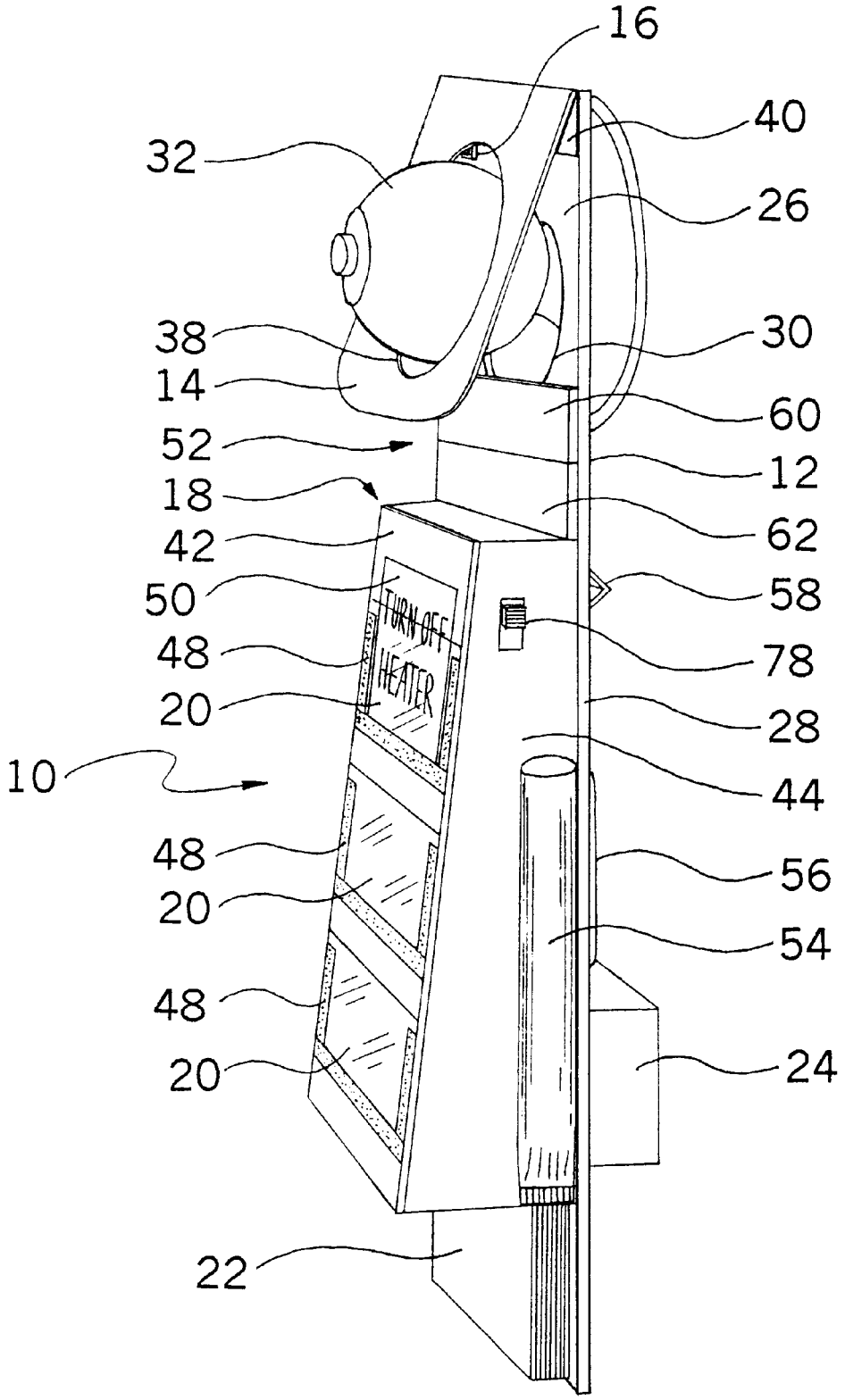
FIG. 2 is a perspective view of the embodiment in FIG. 1 hanging on a doorknob with a securing device buttoned. The doorknob is for illustrative purpose only and forms no part of the invention
Figure 3:
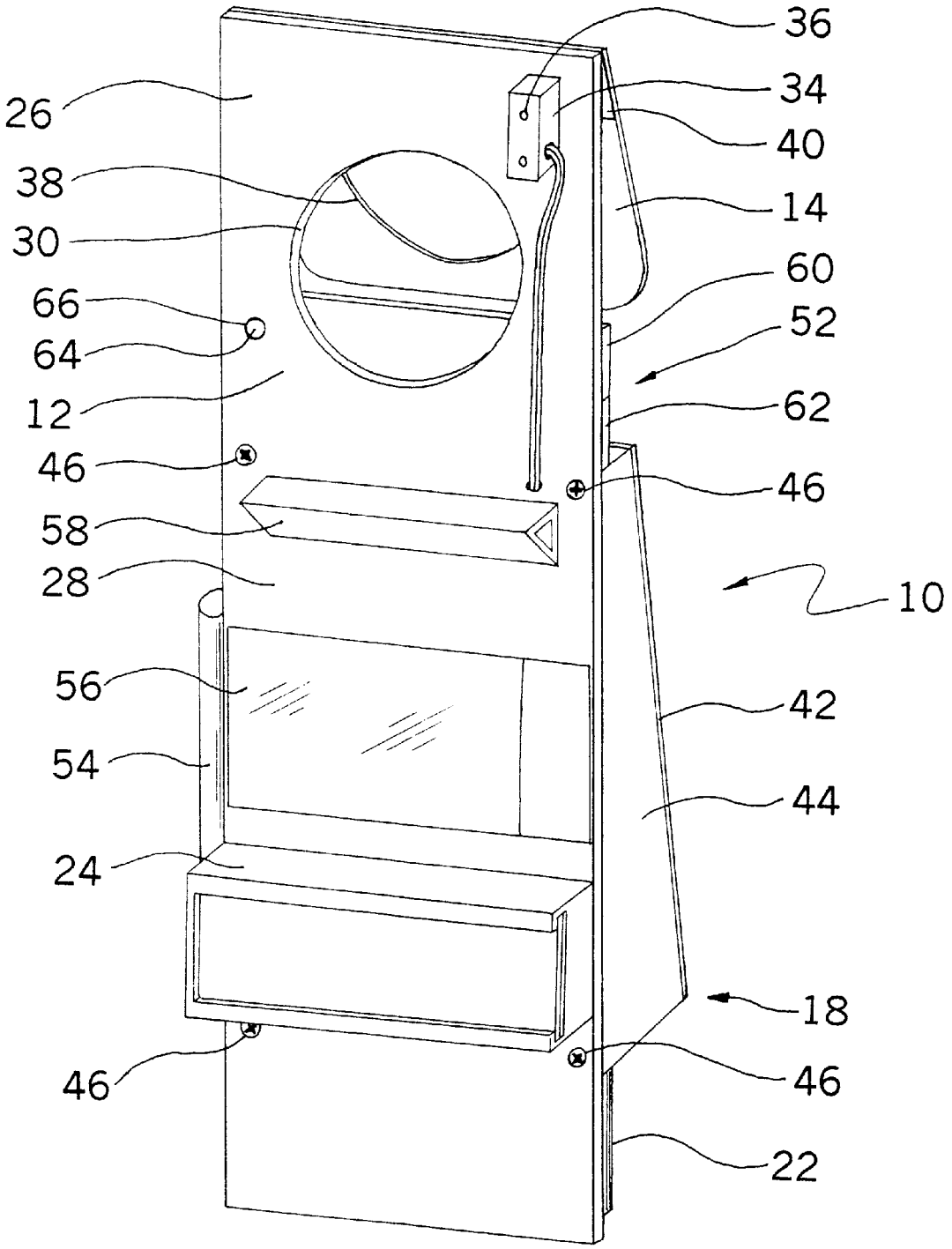
FIG. 3 is a perspective view of the back of the embodiment in FIG. 1.

FIGS. 1, 2 and 3 show a door reminder 10 which includes a hanger 12, a flap 14, a flap-actuated switch 16 which is provided with a spring, a cap 18, holding components or transparent pockets 20, a planar display component or memo pad 22, battery case 24 and an electronic assembly connected to and actuated by the flap-actuated switch 16 for the production of light and sound.

The hanger 12 is a piece of flat and elongate material which can be plastic, celluloid or cardboard. The hanger 12 has a front surface facing away from a door and a back surface facing the door. The hanger 12 is preferably rectangular in shape and having a width of approximately 10 cm and a suitable length. A length of 32 cm is used in this embodiment. The hanger 12 consists of an upper portion of hanger 26 and a lower portion of hanger 28. The upper portion of hanger 26 is provided with a hanger opening 30. The hanger opening 30 is preferably circular in shape and sufficient large to encircle a doorknob 32 which is not a component of the invention. The upper portion of hanger 26 above the hanger opening 30 rests on the shank of the doorknob 32 when the door reminder 10 is ready for use. The diameter of the hanger opening 30 in this embodiment is approximately 6 cm. The hanger 12 is provided with a switch case 34 for housing the flap-actuated switch 16. The switch case 34 includes two expelling holes 36 for expelling the flap-actuated switch 16 from the switch case 34 when necessary. The switch case 34 can be manufactured with the hanger as one integral part when thermoplastic material is used.

The flap 14 is a piece of flat material which can be plastic, celluloid or cardboard. The flap 14 is dimensioned and arranged to be rotatably and horizontally mounted on the upper portion of hanger 26 at a position approximately 3 cm above the hanger opening 30 such that the flap 14 can be rotated towards the front surface of the hanger 12. The flap 14 is provided with a flap opening 38 which is preferably circular in shape. The flap opening 38 has a predetermined size and a predetermined position on the flap 14 such that the doorknob 32 can pass through both the hanger opening 30 and the flap opening 38 when the flap 14 is rotated towards the front surface of the hanger 12. The diameter of the flap opening 38 in this embodiment is approximately 6 cm and the flap opening 38 is approximately 1.6 cm from the axis of rotation of the flap 14. The flap 14 in this embodiment is substantially rectangular in shape with the two corners away from the axis of rotation rounded off. The rectangle is approximately 10 cm×9 cm in size before two corners on one of the two 10 cm long edges are rounded off. The flap 14 can be of other shapes and with a size sufficiently large to accommodate the flap opening 38 but sufficiently small to avoid blocking the view of the lower portion of hanger 28.

The door reminder 10 further includes a flap-hanger hinge 40 which connects the hanger 12 and the flap 14. The flap-hanger hinge 40 in door reminder 10 is a rectangular sheet of resilient material such as celluloid folded once and a small rectangular portion of the flap-hanger hinge corresponding to the position of the opening of the switch case 34 is cut out. The flap-hanger hinge 40 is secured on the hanger 12 and the flap 14 with a suitable adhesive and in a way according to the earlier description regarding the mounting of the flap 14 on hanger 12. The flap-hanger hinge 40 can be of other suitable designs. For example, the flap-hanger hinge 40 can be made from a piece of flexible material such as cloth. A snap fit design which will be described afterwards can also be used. The flap-hanger hinge 40 can be omitted when the hanger 12 and the flap 14 are formed by folding a piece of resilient material such as cardboard and celluloid.

In this embodiment, the flap 14 is maintained at an operative angle of approximately 30 degrees above the front surface of the hanger 12 by two components with urging means, which components include the flap-actuated switch 16 provided with a spring inside and the flap-hanger hinge 40 made of a resilient material. However, the springiness provided by the flap-hanger hinge 40 is not essential to the operation of this embodiment. The operative angle should be sufficiently large to ensure that a hand moving to grasp the doorknob 32 will generate a rotational movement on the flap 14 to turn on the flap-actuated switch 16 but sufficiently small to prevent the flap 14 from blocking the front view of the doorknob 32.

The cap 18 consists a translucent display panel 42 and a tilted supporting frame 44. The translucent display panel 42 is tilted about 7 degrees as shown in FIGS. 1,2 and 3 to make viewing easier. The cap 18 is secured on the hanger 12 with screw members 46 forming a light box such that the top of the cap 18 is approximately 11 cm from the axis of rotation of the flap 14. An opening (not shown in the drawings) can be made on the bottom portion of the tilted supporting frame 44 to facilitate the escape of sound from inside the cap 10.

The holding components or transparent pockets 20 are made of a transparent flexible plastic material. The transparent pockets 20 are secured on the translucent display panel 42 with double-sided adhesive tape 48. The uppermost corners of each of the transparent pockets 20 are not secured on the translucent display panel 42 so that the upper edge of the transparent pocket 20 can be bent slightly away from the surface of the translucent display panel 42 to facilitate the entry of paper when necessary. Another way of securing the transparent pockets 20 on the translucent display panel 42 is by heat sealing. This method is particularly suitable when the transparent pockets 20 open on both left and right side instead of at the top. The transparent pockets 20 can also be made with a stiff and relatively thick plastic material and each includes a U-shaped ledge for mounting on the translucent display panel 42 with adhesive. The number of transparent pockets 20 may be one or more. However, it is recommended that three should be the maximum number of transparent pockets used. A memo slip 50 can be taken from a planar display component or memo pad 22 on the door reminder 10 and a message is written on the memo slip 50 before putting in the transparent pockets 20 for display. The paper of the memo pad 22 should be thin enough to let most of the light from the translucent display panel 42 pass through.

The battery case 24 is mounted on the back of the lower portion of hanger 28 so that it can keep the upper portion of hanger 26 and the lower portion of hanger 28 at approximately the same distance from the surface of the door.

The door reminder 10 further comprises a securing member 52, a pen-holder 54, a storage pocket 56 and a rest support 58 all of which are not essential components of this embodiment and may be omitted.

The securing member 52 consists an upper portion of securing member 60 and a lower portion of securing member 62 rotatably connected to each other. The upper portion of securing member 60 is provided with a press button 64 which is dimensioned to fit tightly in a button hole 66 made on the hanger 12. The lower portion of securing member 62 is secured on the hanger 12 right below the hanger opening 30 with a strong adhesive such that the upper portion of securing device 60 can be rotated to cover a portion of the hanger opening 30. A snap fit can also be used instead of the adhesive for mounting the securing member 52 on the hanger 12. The upper portion of securing member 60 and the lower portion of securing member 62 can be made in one piece from the same resilient material such as celluloid with a thin portion of the same material connecting both portions. The press button 64 should be provided on the right side of the securing member 52 since most people are right-handed. When in use, the upper portion of securing member 60 decreases the area of the hanger opening 30 making it difficult to remove the door reminder from the doorknob 32 without unbuttoning the securing member 52 first.

The pen-holder 54 is constructed of a plastic material and it is secured on the right side of the cape 10. A writing instrument is to be provided by the user of the device. A marker with fine point and attractive color is recommended.

The storage pocket 56 is made of a plastic material and is secured on the back of the lower portion of hanger 28. The storage pocket 56 is for storing any memo slips which can be used repeatedly.

The rest support 58 is for supporting the mid portion of the door reminder 10 when the device is put down horizontally on a flat surface with the back of the device facing downwards. Without the rest support 58, the portion of the hanger 12 immediately above the tilted supporting frame 44 may bent after a period of time when the upper portion of the device rests on the switch case 34. The rest support 58 can be omitted when the hanger 12 is made of a strong or resilient material.

Figure 4:
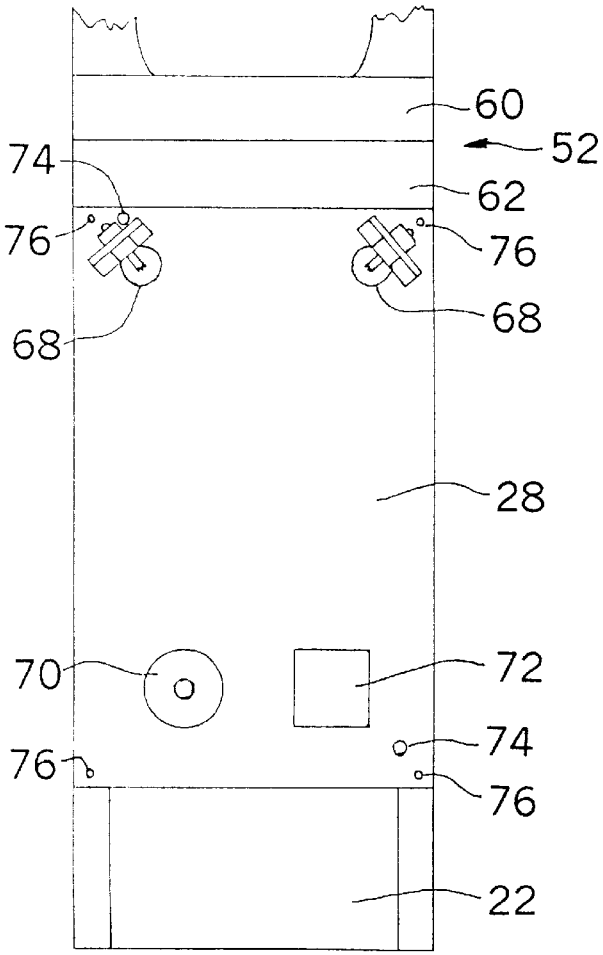
FIG. 4 is a fragmentary plan view of the embodiment in FIG. 1 with the cap removed showing electronic components in their predetermined positions before wiring.

FIG. 4 shows a fragmentary plan view of an embodiment in FIG. 1 with the cap 10 removed revealing the electronic components which include two light producing components 68, a sound producing component 70 and a sound circuit board 72 in their predetermined position before wiring. Two wiring holes 74 and four screw holes 76 are also revealed. The light producing components 68 are halogen bulbs both of which are placed near the top within the cap 10 for maximum illumination of the most important message displayed on the top. The sound circuit board 72 includes data storage means for producing specific electronic signals for sound production in sound producing component 70. It has been noted short bursts of sound attracts more attention than continuous sound of unchanged volume and that interesting sound of living creatures, e.g. sound of crickets, is very effective in attracting people's attention. A sound switch 78 shown in FIGS. 1 and 2 is included for switching off only the sound when silence is to be maintained. A volume control for sound can also be added if required.

Figure 5:
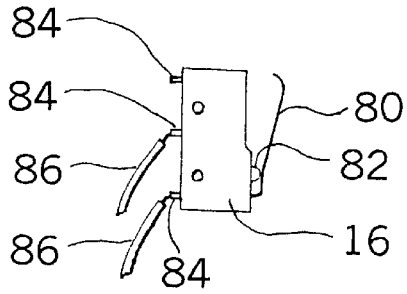
FIG. 5 is a side plan view of a flap-acted switch with wires connected in such a way that enables the switch to be turned on when a metal arm of the switch is pressed.

FIG. 5 shows a side plan view of the flap-actuated switch 16 used in the door reminder 10. The flap-actuated switch 16 is a SM-3 micro switch modified slightly. The SM-3 micro switch is a standard electronic part available at most electronic parts store in Hong Kong. The SM-3 micro switch comprises a metal arm 80 which is slightly rotatable and the metal arm 80 is in touch with a button 82 on the micro switch. The SM-3 micro switch is modified into the flap-actuated switch 16 by bending the tip of the metal arm 80 slightly towards the surface of the SM-3 micro switch as shown in FIG. 5 to enable the flap 14 to be turned more smoothly without scratching. The flap-actuated switch 16 comprises three connecting points 84. Two electric wires 86 are connected to two of the connecting points 84 near to the button 82 so that the flat-actuated switch 16 is on when the metal arm 80 is pressed.

Figure 6:
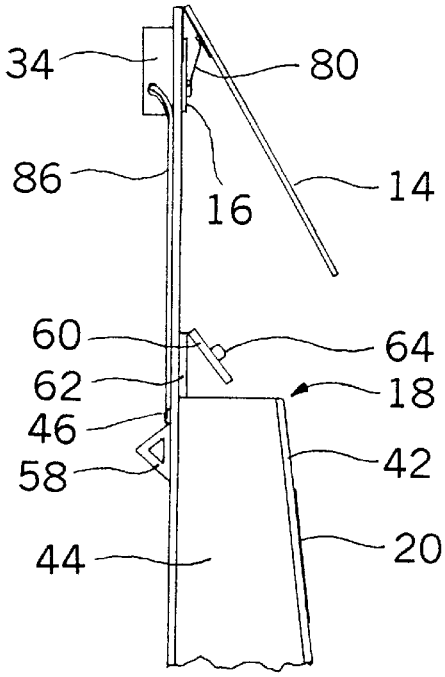
FIG. 6 is a fragmentary side plan view of the embodiment in FIG. 1 with the metal arm of the flap-actuated switch supporting a flap at an operative angle.

The flap-actuated switch 16 is fitted into the switch case 34 with the metal arm 80 pointing upwards as shown in FIG. 6. A hole is made on one side of the switch case to let the electric wires 86 come out of the switch case 34 as shown in FIG. 3. The position of the switch case 34 can be on the left or right of the upper portion of hanger 26 and should keep the upper surface of the flap-actuated switch 16 approximately 0.8 cm below the axis of rotation of the flap 14. Ihe flap 14 should be kept at the operative angle of approximately 30 degrees from the front surface of the hanger 12 mainly by the push of the metal arm 80 due to the force exerted by the spring inside the flap-actuated switch 16. If the metal arm 80 does not touch the flap 14 at the operative angle, the metal arm 80 should be bent away from the surface of the flap-actuated switch 16 at the point of contact with the button 82 until the tip of the metal arm 80 touches the flap 14. This will ensure that the flap-actuated switch can be turned on without having to push the flap 14 very close to the front surface of the hanger 12. The metal arm 80 is rather easily bent at this point because the metal arm 80 is made narrower at this point for bending. The flap-actuated switch 16 is turned on by a hand moving to grasp the doorknob 32 when the metal arm 80 is pressed by the flap 14. The flap-actuated switch 16 is turned off when the hand is removed allowing the metal arm 80 to rotate away from the front surface of the hanger 12 due to the springiness of the spring inside the flap-actuated switch 16.

Figure 7:
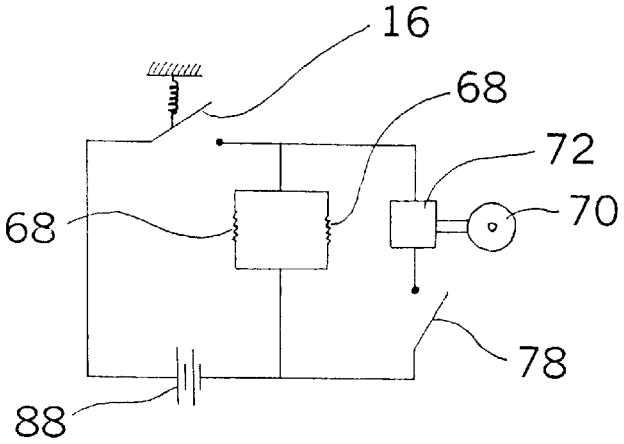
FIG. 7 is a schematic diagram of the electric circuitry of the electronic assembly in the embodiment shown in FIG. 1.

FIG. 7 is a schematic diagram of the electronic circuit of the door reminder 10. Electricity current from batteries 88 flows through the light producing components 68, the sound circuit board 72 with an integrated circuit chip for specific sound production and the sound producing component 70 when both the flap-actuated switch 16 and the sound switch 78 are on and both light and sound are produced. When only the flap-actuated switch is on, only light is produced. The door reminder 10 does not include a power switch to cut off the electricity completely to avoid the situation of people forgetting to turn it on. The door reminder 10 should be taken away from the doorknob 32 when no message is on display to prevent the cry wolf situation of producing light and sound when no message is on display.

Figure 8:
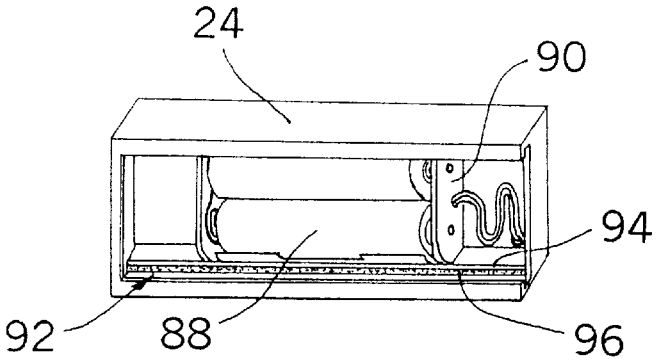
FIG. 8 is a perspective view of a battery case of the embodiment in FIG. 1 opened showing a battery holder, batteries and a pressure pad.

FIG. 8 shows the battery case 34 which is opened to reveal the batteries 88, a battery holder 90 and a pressure pad 92. The pressure pad 92 consists a stiff layer 94 and a spongy layer 96. The pressure pad 92 is for creating a width inside the battery case 24 slightly lees than the width of the battery holder 90 so that a small and even pressure is created to enable the horizontal position of the battery holder 90 within the battery case 34 to be adjusted. Adjustment may be necessary when a heavy pen is put into the pen-holder 54 tilting the door reminder 10 on the doorknob 32.

Figure 9:
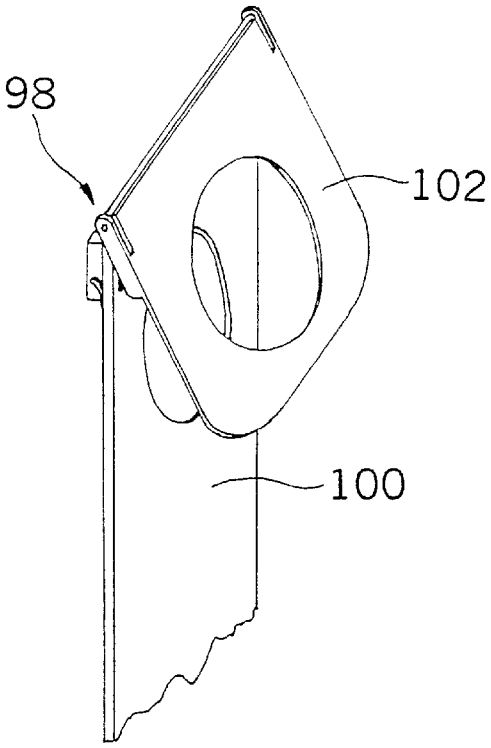
FIG. 9 is a fragmentary perspective view of a hanger with the flap-actuated switch and a flap connected by a snap fit flap-hanger hinge.

When speedy assembly is required, an embodiment with a snap fit flap-hanger hinge 98 shown in FIG. 9 replacing the flap-hanger hinge 40 of the embodiment in FIG. 1 is more desirable. The hanger 100 and flap 102 in FIG. 9 are connected by the snap fit flap-hanger hinge 98. The flap 102 is made of a resilient plastic material allowing part of the hinge 96 on the flap 102 to be extended outwards for mounting.

Figure 10:
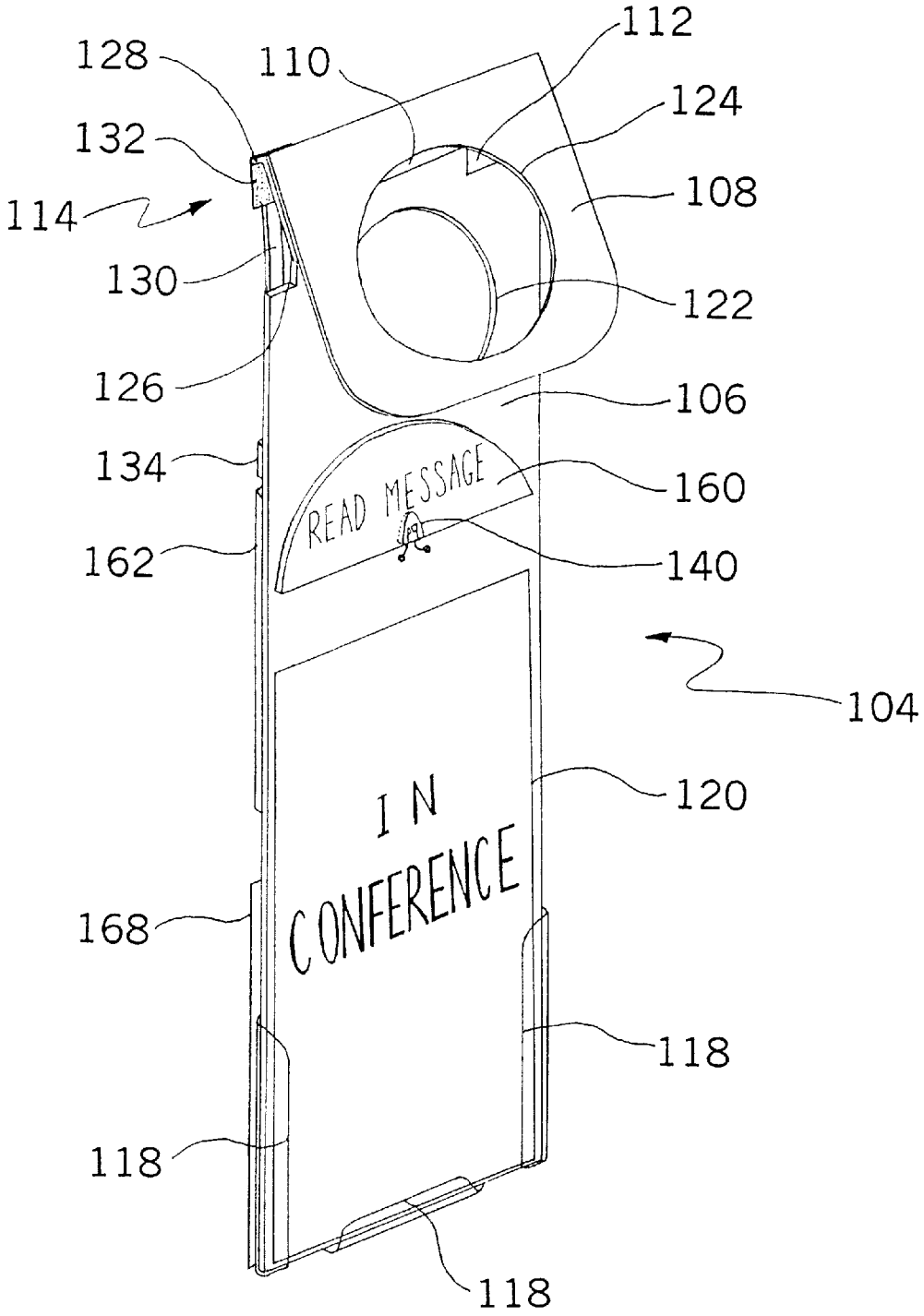
FIG. 10 is a perspective view of another embodiment of my invention with three clips for holding a message card and with a light emission diode under a light dispersion plate.
Figure 11:
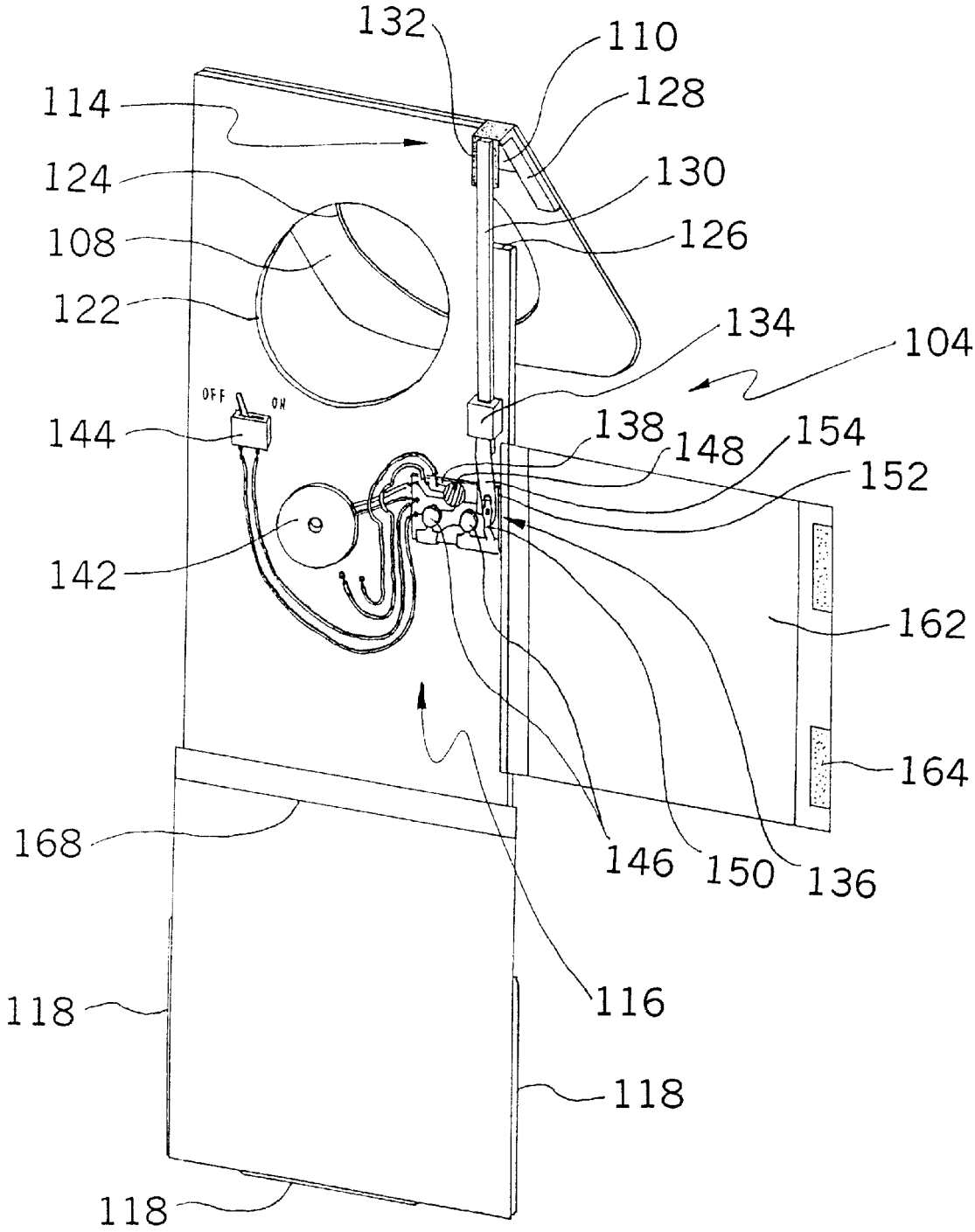
FIG. 11 is a perspective view of the back of the embodiment in FIG. 10 with a back cover which is opened to reveal the electronic parts.

FIGS. 10 and 11 show a door reminder 104 which is another embodiment of my invention. The door reminder 104 does not include a translucent display panel and is suitable for displaying a single message in a well-lit area such as an office. The door reminder 104 includes a hanger 106, a flap 108, a flap-hanger hinge 110, an angle adjuster 112, a transmission mechanism 114, an electronic assembly 116, holding components or clips 118 and a planar display component or message card 120.

The hanger 106 is provided with a hanger opening 122 and the flap 108 is provided with a flap opening 124. The construction and dimensions of the hanger 106, the hanger opening 122, the flap 108 and the flap opening 124 are essentially the same as that of their counterparts in the door reminder 10. However, a cutout 126 of a size approximately 1 cm×3 cm is made on one of the two upper corners of the hanger 106.

The flap-hanger hinge 110 is a rectangular sheet of resilient material folded once and it is secured on the hanger 106 and the flap 108 in the same way as described in the description of the door reminder 10.

The angle adjuster 112 is a rectangular sheet of resilient material folded once. It is smaller in size than the flap-hanger hinge 110 which has a similar construction. The angle adjuster 112 is releasably secured on hanger 106 with the folded line near and parallel to the axis of rotation of the flap 108. By moving the angle adjuster 112 up and down the hanger 106, the operative angle can be adjusted.

The transmission mechanism 114 comprises an L-shaped lever 128, a connector 130, a lever-connector hinge 132 and a connector guard 134. The L-shaped lever 128 is constructed of a stiff plastic or metallic material. The short arm of the L-shaped lever 128 is approximately 0.6 cm in length and the long arm should be long enough to allow it to be secured firmly on the flap 108 with adhesive as shown in FIG. 11. A length of 3 cm is recommended. The lever-connector hinge 132 is a piece of flat, tough and flexible material, e.g. a piece of cloth, secured on the short arm of the L-shaped lever 128 and one end of the connector 130 with a strong adhesive. The connector 130 is constructed of a resilient material such as celluloid and cardboard. It is approximately 9 cm in length and approximately 0.7 cm in width. A portion of the connector 130 near the end away from the L-shaped lever 128 is covered with a connector guard 134 to facilitate the transmission of movement from the flap 108 and to prevent the connector 130 from being pushed out of position accidentally. The thickness of the connector 130 should be sufficiently small to allow a 3 cm portion the connector 130 to be bent easily for approximately 0.6 cm from the back to the front of the hanger 104. The movement of the flap 108 is transmitted by the transmission mechanism 114 to a flap-actuated switch 136.

The electronic assembly 116 comprises a light and sound circuit board 138, a light emission diode 140, a sound producing component 142 and a power switch 144. The light and sound circuit board 138 is provided with the flap-actuated switch 136, two button batteries 146 and a data storage chip 148. The flap-actuated switch 136 comprises a spring arm electric pole 150, a flat electric pole 152 and a switch strip 154. The switch strip 154 is made of a non-conducting and resilient material such as celluloid. It is approximately 3 cm long and approximately 0.05 cm thick and it is sandwiched between the spring arm electric pole 150 and the flat electric pole 152. A push-detecting hole 156 and a pull-detecting hole 158 are provided on the switch strip 154. The push-detecting hole 156 is 0.1 cm from one end of the switch strip 154 and the pull-detecting hole 158 is 0.1 cm from the push-detecting hole 156. The diameters of the two holes 156 and 158 are approximately 0.4 cm. The end of the switch strip 154 away from the holes 156 and 158 is secured with adhesive on the end of the connector 130 near the connector guard 134. When the spring arm electric pole 150 is in contact with the flat electric pole 152 through either the push-detecting hole 156 or the pull-detecting hole 158, the flap-actuated switch 136 is on.

The data storage chip 148 contains digitally recorded sound data for the reproduction of specific sound from the sound producing component 142 and contains circuitry for producing blinking light from the light emission diode 140 which is mounted on the front of the hanger 106. The light from the light emission diode 140 is dispersed by a light dispersion plate 160 for attracting greater attention. Since door reminder 104 is designed with portability in mind, the power switch 144 is included in this embodiment to turn off the power from the button batteries 146 when necessary. For example, when the door reminder 104 is carried in a bag with the flap 108 pressed against the hanger 106 by clothing.

The door reminder 104 further includes a back cover 162 for protecting the electronic components on the back and for preventing short circuit. One edge of the back cover 162 is pemanently secured on the back of the hanger 106 and the other edge is releasably secured on the back of the hanger 106 with double-sided adhesive tape 164.

Since the flap-actuated switch 136 in door reminder 104 does not include an urging component, the urging components required for maintaining the flap 108 at the operative angle of approxitely 30 degrees above the hanger 106 are the flap-hanger binge 110 and the angle adjuster 112.

Figure 12A:
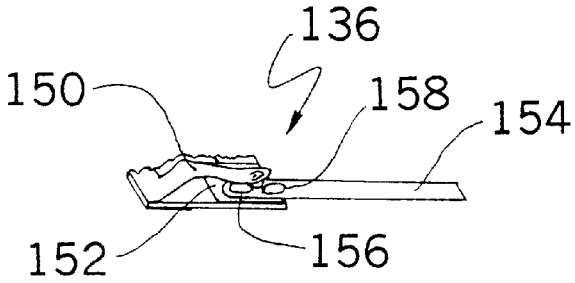
FIG. 12A shows a perspective view of a flap-actuated switch of the embodiment shown in FIG. 11 with the switch at the off position.
Figure 12B:
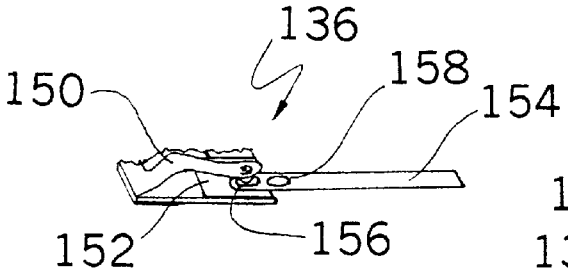
FIG. 12B shows a perspective view of the flap-actuated switch in FIG. 11 at the on position.

In FIG. 12A, the spring arm electric pole 150 rests on a ridge between the push-detecting hole 156 and the pull-detecting hole 158. The flap-actuated switch 136 is off. The angle between the flap 108 and the front surface of the hanger 106 corresponding to this switch position should be within 20 degrees to 30 degrees or within 150 degrees to 160 degrees In FIG. 12B, the spring ann electric pole 150 is in contact with the flat electric pole 152 through the push-detecting hole 156. The flap-actuated switch 136 is on. The angle between the flap 108 and the front surface of the hanger 106 corresponding to this switch position should be smaller than 20 degrees or greater than 160 degrees but not greater than 180 degrees.

Figure 12C:
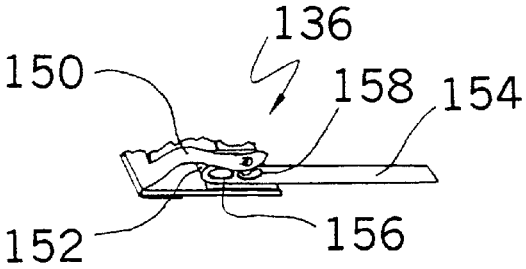
FIG. 12C shows a perspective view of the flap-actuated switch in FIG. 11 at another on position.

In FIG. 12C, the spring arm electric pole 150 is in contact with the flat electric pole 152 through the pull-detecting hole 158. The flap-actuated switch is on. The angle between the flap 108 and the front surface of the hanger 106 corresponding to this switch position should be greater than 30 degrees but smaller than 150 degree.

If no pull detection of the flap is necessary, only the push-detecting hole 158 is needed.

The position of the light and sound circuit board 140 should be adjusted before securing on the back of the hanger 106 such that the flap-actuated switch 136 is turned on when the flap 108 reaches approximately 20 degrees above the front surface of the hanger 106. The angle adjuster 112 is then adjusted to keep the flap 108 at the operative angle of approximately 30 degrees.

When door reminder 104 is mass produced, a marked position for the light and sound circuit board 138 should be provided on each hanger 106 so that no adjustment is needed for assembly.

Figure 13:
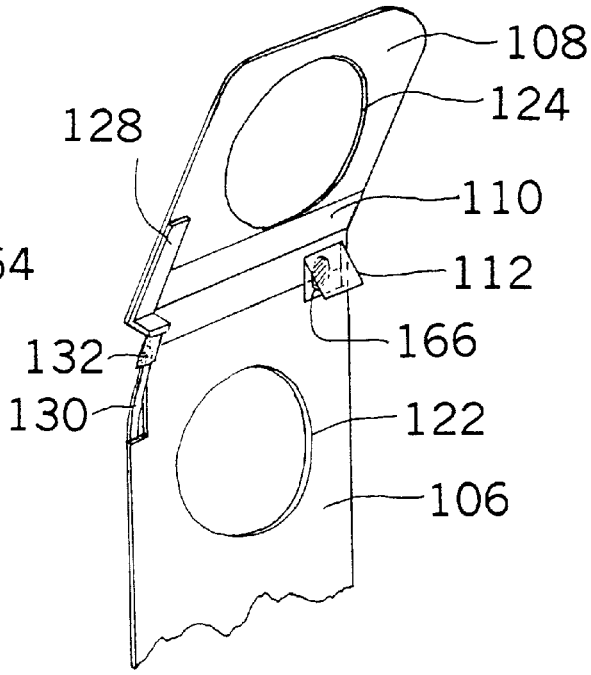
FIG. 13 is a fragmentary perspective view of the embodiment in FIG. 10 showing the upper portion of the invention with the flap lifted up showing a flap angle adjuster.

FIG. 13 shows the angle adjuster 112 releasably secured on the hanger 106 with poster putty 166. When the angle adjuster 112 is moved upwards on the hanger 106, the operative angle of the flap 108 increases and vice versa.

If thermoplastic is used for manufacturing the flap 108 and the L-shaped lever 128 as one integral part, the long arm of the L-shaped lever 128 can be omitted and only a short lever perpendicular to the flap is required. If the connector 130 is also made from thermoplastic, a snap fit hinge design can be used for connecting the short lever and the connector 130. The flap 108 can also be made from transparent plastic so that the whole doorknob encircled by the flap 108 can be distinctly visible.

The holding components or clips 118 in door reminder 104 are made of a resilient material such as celluloid. The are dimensioned and structured to be mounted on the left, right and bottom edges of the hanger 106 with double-sided adhesive tape for holding a planar display component or message card 120. The entry points of each of the clips 118 for the message card 120 is slightly bent away from the front surface of the hanger 106 to facilitate entry. The three clips can also be made as one integral part from one piece of celluloid. This method would use more material but the assembly can be done faster.

While three clips 118 are used in the embodiment shown in FIG. 11, other embodiments which comprise a greater or smaller number of clips of suitable design to be mounted on suitable positions of a hanger can also be constructed. A large memo pad can be used instead of the message card 120 if a strong metal clip is mounted on the hanger. If only one permanent message is displayed, the message can be printed directly on a hanger.

The door reminder 104 further includes a card storage pocket 168 for storing message card 120 not in use. However, the card storage pocket 168 is not an essential part of the door reminder 104.

Figure 14:
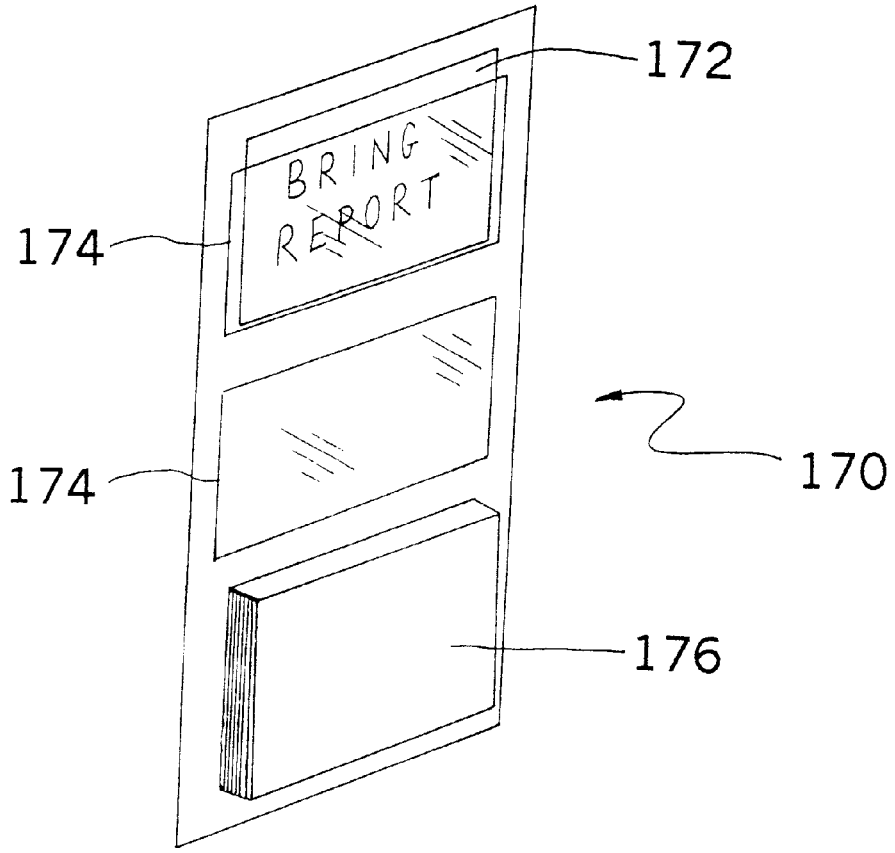
FIG. 14 is a perspective view of a memo slip displaying card which can be used for displaying memo slips on the embodiment in FIG. 10.

In addition to displaying the message card 120, door reminder 104 can also be used for displaying a memo slip displaying card 170 which is shown in FIG. 14. The memo slip displaying card 170 can be used for displaying memo slips 172 in transparent pockets 174 as well as message written on memo pad 176.

Door reminder 104 is not restricted to the use of delivering personal messages. It can also be used for delivering advertising messages, i.e. to remind people of a particular product. The advertised message can be printed on the hanger 106 and the flap 108 and further reinforced by interesting audio message produced by the sound producing component 142 promoting the same product. Since a door reminder is a useful device, it can be sold to customers instead of being given away.

It should be understood that while the light emission diode 140 in door reminder 104 is used for attracting the attention of people towards the message card 120, the light emission diode 140 can also be considered having the function of delivering message as it delivers the message that a message card 120 is on display. When more than one light emission diodes are arranged in a specific orientation on a door reminder, a specific message can be delivered without the use of any non-electrical display means for delivering message.

Figure 15:
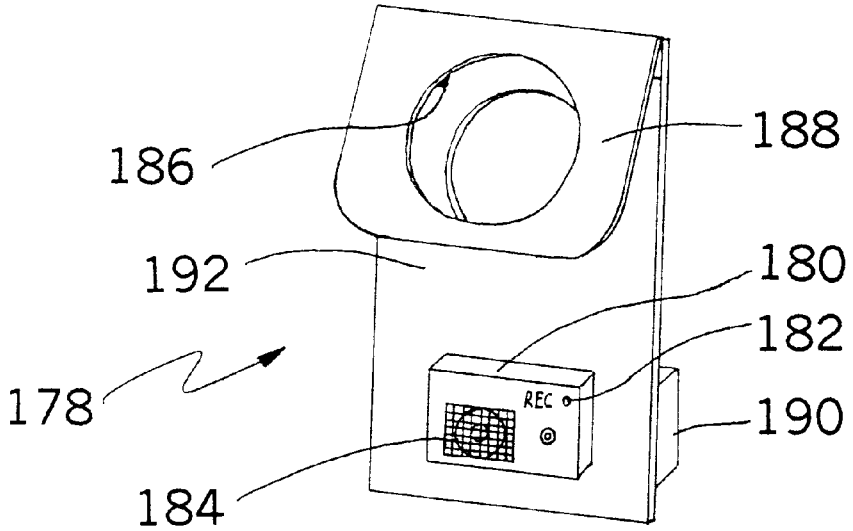
FIG. 15 is a perspective view of another embodiment of the invention with a voice recorder.

FIG. 15 shows a door reminder 178 which is yet another embodiment of my invention. This embodiment is suitable for use when audio message is preferred over visual message. This embodiment includes a voice recorder 180 which can be used for recording a few short messages while a record button 182 is pressed and playing them back once on a speaker 184 after a flap actuated switch 186 has been turned on by the movement of the flap 188. A battery case 190 is mounted on the back of the hanger 192 so that the battery case 190 can keep the hanger 192 vertical. Non-electrical means of delivering visual message is not included in this embodiment.

Although specific embodiments have been utilized in illustrating the present invention, it will be understood that details of the construction shown may be altered or omitted without departing from the spirit of the invention as defined by the following claims:

I claim:

1. A door reminder for hangng on the shank of a doorknob on a door for delivering a message, comprising:

a. a hanger which is a substantially elongated planar body portion of rigid material having a hanger opening, said hanger opening is a substantially centrally disposed opening extending perpendicularly through the plane of said planar body portion, said hanger opening having a predetermined shape and sufficient size to allow said doorknob to pass through, said hanger consists of an upper portion of hanger and a heavier lower portion of hanger, said lower portion of hanger being the portion of said hanger below said hanger opening when said hanger is hung vertically on the shank of said doorknob through said hanger opening such that said heavier lower portion of said hanger is below said doorknob and said upper portion of hanger being the portion of said hanger above said lower portion of hanger, b. a flap rotatably and horizontally mounted on said upper portion of hanger above said hanger opening, said flap having a flap opening of predetermined shape and sufficient size such that said doorknob can pass through said flap opening when said flap is rotated towards the surface of said hanger such that when said hanger is hanging on the shank of said doorknob, said hanger is located between said door and said flap, c. at least one electronic device which contains switch means for causing said electronic device to be actuated by the rotational movement of said flap, said electronic device having a function which can be utilized for delivering said message; and d. urging means for maintaining said flap at an operative angle above the surface of said hanger when said hanger is hanging on the shank of said doorknob and when said flap is not being moved, said operative angle being sufficiently large to ensure that a hand moving to grasp said doorknob will generate a rotational movement on said flap towards the surface of said hanger to turn on said switch means, said urging means being used for storing a portion of the energy generated by said hand for moving said flap towards the surface of said hanger and spending said portion of the energy to move said flap back to said operative angle to turn off said switch means when said hand is removed from said doorknob.

2. A door reminder as described in claim 1 wherein said hanger opening and said flap opening are circular in shape.

3. A door reminder as described in claim 1 wherein said at least one electronic device is selected from a group consisting of:

a. a light emitting electronic device, and b. a sound emitting electronic device.

4. A door reminder as described in claim 3 wherein said at least one electronic device is sound emitting electronic device, said sound emitting electronice device is a voice recorder with a play back function activated by said switch means.

5. A door reminder as described in claim 1 wherein said urging means is a spring with a V-shaped cross-section formed by folding a flat piece of resilient material once.

6. A door reminder as described in claim 1 further including a mechanism which enables said switch means to be turned on when said flap at said operative angle is pulled away from the front surface of said hanger.

7. A door reminder as described in claim 1 further including securing means for preventing said door reminder from being removed easily from said doorknob.

8. A door reminder as described in claim 1 further including non-electrical display means for delivering an additional message.

9. A door reminder as described in claim 8 wherein said non-electrical display means for delivering said additional message comprises holding means for holding planar display means for delivering said additional message.

10. A door reminder as described in claim 9 wherein said holding means is selected from a group consisting of:

a. at least one transparent pocket, and b. at least one clip.

11. A door reminder as described in claim 9 wherein said planar display means is selected from a group consisting of:

a. a memo slip, b. a memo pad, and c. a message card.

12. A door reminder as described in claim 9 wherein said at least one electronic device is light emitting electronic device with a relatively high luminosity further includes a cap with a translucent display panel on which said holding means is mounted.

13. A door reminder as described in claim 12 further including a penholder mounted on one side of said cap.

14. A door reminder as described in claim 13 further including means for counterbalancing the weight of a writing instrument put into said penholder.

15. A door reminder as described in claim 9 further including storage means secured on the back of said hanger for storing said planar display means.

16. A door reminder for hanging on the shank of a doorknob on a door for delivering a message, comprising:

a. a hanger having means for hanging said door reminder on the shank of said doorknob, b. a flap dimensioned and structured to be rotatably mounted on said hanger, said flap having a flap opening of predetermined shape and sufficient size such that said doorknob can pass through said flap opening when said flap is rotated towards the surface of said hanger such that when said hanger is hanging on the shank of said doorknob, said hanger is located between said door and said flap and a hand moving to grasp said doorknob is able to push said flap towards said hanger on the shank of said doorknob, c. at least one device which contains switch means structured to be actuated by the rotational movement of said flap, said device having a function which can be utilized for delivering said message and, d. urging means for maintaining said flap at a predetermined angle relative to said hanger such that a hand moving to grasp said doorknob is able to actuate said device by pushing said flap at said predetermined angle towards said hanger.

* * * * *